United States Patent [19]

Yamaguchi et al.

[11] 4,055,313

[45] Oct. 25, 1977

[54] APPARATUS FOR EXCHANGING REWOUND ROLLS IN A ROLL SLITTING AND REWINDING MACHINE

[75] Inventors: Toshiaki Yamaguchi; Keizo Narita; Hideo Mukai, all of Kyoto, Japan

[73] Assignee: Nishimura Seisakusho Co., Ltd., Kyoto, Japan

[21] Appl. No.: 597,402

[22] Filed: July 18, 1975

Related U.S. Application Data

[63] Continuation of Ser. No. 393,835, Sept. 4, 1973, abandoned.

[51] Int. Cl.[2] ..... B65H 35/02

[52] U.S. Cl. ..... 242/56.4; 242/79

[58] Field of Search ..... 242/55, 55.1, 56 R, 242/56 A, 56.2–56.9, 58.6, 64, 67.1 R, 79–81

[56] References Cited

U.S. PATENT DOCUMENTS

| | | | |
|---|---|---|---|
| 1,506,327 | 8/1924 | Perrault | 242/56.9 X |
| 3,157,371 | 11/1964 | Billingsley | 242/56.2 |
| 3,258,136 | 6/1966 | Rockstrom et al. | 242/58.6 X |
| 3,690,583 | 9/1972 | Herman | 242/81 X |

*Primary Examiner*—Stanley N. Gilreath
*Assistant Examiner*—John M. Jillions
*Attorney, Agent, or Firm*—Morgan, Finnegan, Pine, Foley & Lee

[57] ABSTRACT

A roll slitting and rewinding machine apparatus for exchanging rewound rolls comprises a frame holding a plurality of slitted strip rewinding roll supporting means arranged in two rows and a carrier rotatably supporting said frame so that said frame is movable from a vertically arranged position and a horizontally arranged position. The carrier being movable from a forward position to a retracted position, whereby when said carrier takes said forward position with said frame taking said first position the rewinding rolls are in condition of rewinding operation while when said carrier takes said retracted position with said frame taking said second position the rewinding rolls are removed from their respective support means.

12 Claims, 2 Drawing Figures

APPARATUS FOR EXCHANGING REWOUND ROLLS IN A ROLL SLITTING AND REWINDING MACHINE

This is a continuation of application Ser. No. 393,835 filed Sept. 4, 1973 now abandoned.

BACKGROUND OF THE INVENTION

The present invention relates to apparatus for exchanging rewound rolls in a roll slitting and rewinding machine.

In slitters a wide and long continuous sheet of paper or film from a supply roll is slitted and the resulting slitted strips are rewound to slit rewinding rolls. The operation of removing slitted-strip rewound rolls from the machine and exchanging them with fresh bobbins or cores for rewinding rolls takes much time and labor, forming the cause of failure to shorten the total working time. Particularly, in case of obtaining rewound rolls of a large diameter, the heavy weight and large bulk make handling more difficult.

The principal object of the invention is to provide an apparatus for exchanging rewound rolls in a roll slitting and rewinding machine, in which such the draw-backs and disadvantages as mentioned in the above can be avoided.

Another object of the invention is to provide an apparatus for exchanging rewound rolls in a roll slitting and rewinding machine, in which the rewound rolls can be entirely mechanically and efficiently removed from the machine and exchanged for fresh ones.

Other objects and advantages of the invention will become apparent from the following detailed description of the invention.

SUMMARY OF THE INVENTION

Apparatus for exchanging rewound rolls in a roll slitting and rewinding machine according to the invention comprises a frame holding a plurality of slitted strip rewinding roll support means arranged in two rows and a carrier rotatably supporting said frame so that said frame is movable from the first position in which said two rows of roll support means are arranged vertically to the second position in which said two rows of rewinding roll support means are arranged horizontally. Said carrier is movable from a forward position to a retracted position. With this construction, when said carrier takes said forward position with said frame taking said first position the rewinding rolls are in condition of the rewinding operation while when said carrier takes said retracted position with said frame taking said second position the rewinding rolls are removed from their respective support means.

In a preferred embodiment of the invention the apparatus according to the invention further includes means for receiving and transferring out the rewound rolls removed from said respective support means.

In a further preferable embodiment of the invention, said carrier is further movable from said retracted position to a further retracted position in which fresh bobbins or cores for rewinding rolls may be supplied to said rewinding roll support means. In this connection apparatus according to the invention may further include means for supplying fresh bobbins or cores for rewinding rolls to said rewinding roll support means.

BRIEF DESCRIPTION OF THE DRAWINGS

For a better understanding of this invention, reference may be made to the accompanying drawings wherein the same reference numerals have been used to denote identical parts.

DETAILED DESCRIPTION OF THE PREFERRED EMBODIMENT OF THE INVENTION

Figure 1:
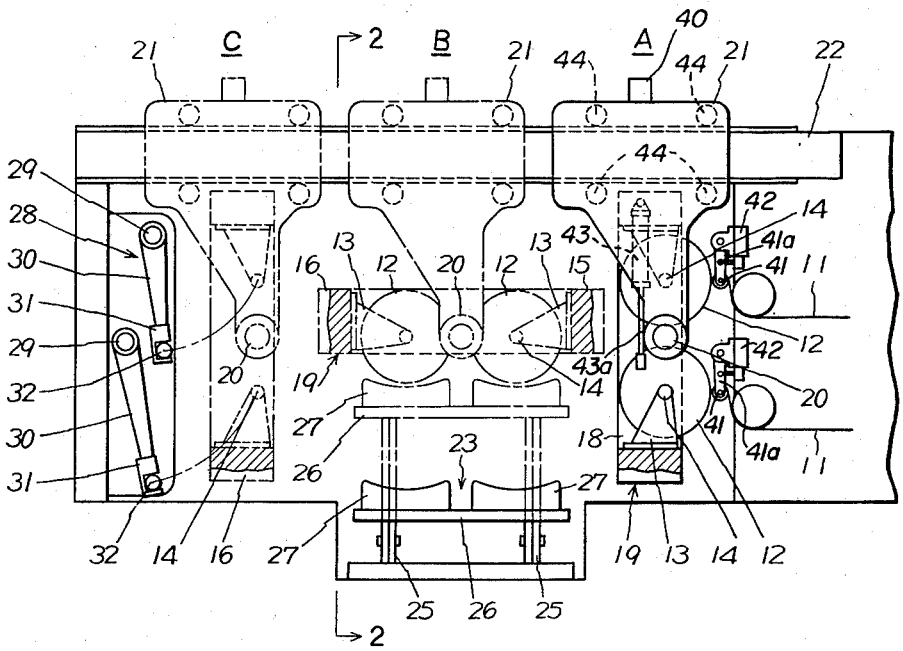
FIG. 1 is a schematic illustration of the apparatus for exchanging rewound rolls in a roll slitting machine embodying the invention.
Figure 2:
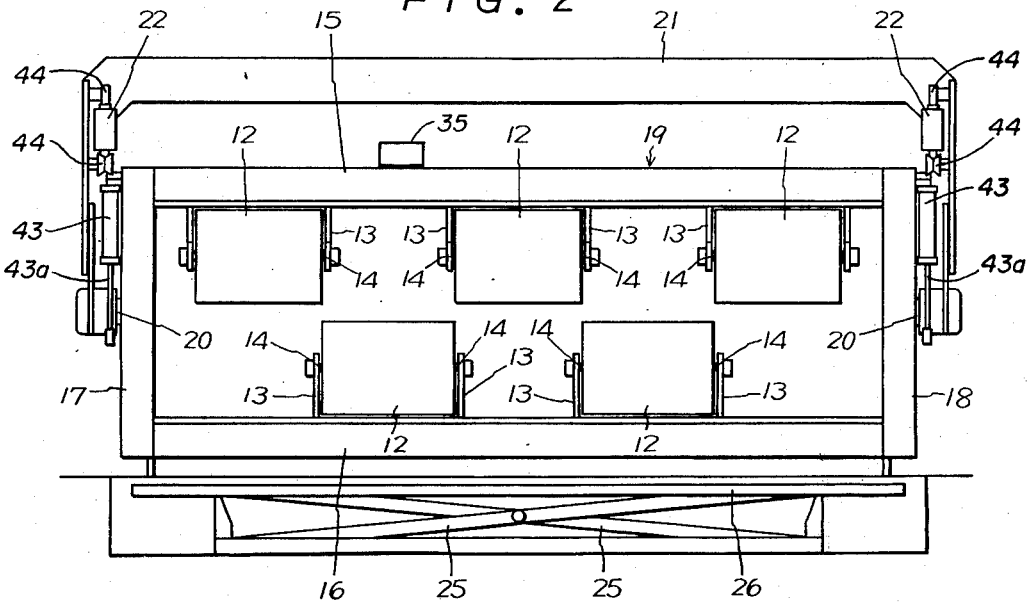
FIG. 2 is a vertical sectional view taken along the line 2—2 in FIG. 1.

Referring now to FIGS. 1 and 2, strips 11 slitted by a slitting mechanism (not shown) are rewound into separate rewinding rolls 12 with adjacent slitted strips being alternatively vertically separated from each other. The slitting mechanism may be any of the conventional ones. The winding rolls 12 are arranged in parallel in two different levels providing an upper group of rewinding rolls and a lower group of rewinding rolls. Each rewinding roll 12 is rotatably supported by its own roll support mechanism. In the embodiment illustrated in the drawings, the support mechanism comprises a pair of support arms 13 each provided with a winding core support axle 14 at its free end. Although the winding core is usually shaped in the form of cylindrical paper tube, it may be shaped in any other form, for example, in the form of a bobbin having flanges at its opposite ends. The winding core in the form of a cylindrical tube is supported at its opposite ends by the support axles 14 carried by the arms 13. The cylindrical paper tube is secured to the support axles 14 by any suitable securing means. For example, the cylindrical paper tube is provided with central opening at its opposite end walls for insertion of support axles 14 and the paper tube is secured to the axles 14 by imparting thrust by means of a spring. The paper tube may be secured to the axles by any other clamping means. The engagement and disengagement of the axles 14 with the cylindrical paper tube with the clamping and releasing means between them may be carried out entirely mechanically and simultaneously.

It will be understood that any convenient or conventional drive means may be utilized for rotating support axles 14, such as by a conventional drive means (indicated, for example, by reference number 35 in FIG. 2).

The support arms 13 for the rewinding rolls 12 in the upper level are secured to an upper beam 15, while the support arms 13 for the rewinding rolls 12 in the lower level are secured to a lower beam 16. The upper and lower beams 15 and 16 are connected together by connecting rods 17 and 18 to form a rectangular holder frame 19. The distance between the support arms 13 in each pair can be changed or adjusted according to the width of slitted strips. This may be achieved by making adjustable the position of attachment of support arms 13 to the beams 15 and 16. That is, support arms 13 may be mounted to beams 15 and 16 so that the distance between corresponding pairs of arms 13 is adjustable.

The frame 19 is carried at centers of length of connecting rods 17 and 18 by a hanger frame 21 which is shaped in a substantially U-shaped form. The reference numeral 20 indicates the support axles for supporting the frame 19. The support axles 20 are carried by the hanger frame 21. The frame 19 is rotatable for 90° about the support axles 20 so that it is movable from the first position to the second position. In the first position the two rows of rewinding rolls 12 are arranged vertically while in the second position the two rows of rewinding rolls 12 are arranged horizontally.

It will be understood by those skilled in the art that any convenient means may be utilized for rotating frame 19. For example, hydraulic cylinder 43 may be pivotally attached to carrier 21 with cylinder rod 43*a* pivotally attached to frame 19. Thus, when rod 43*a* is retracted within cylinder 43, frame 19 is rotated on axles 20.

The hanger frame 21 is suspended on a pair of horizontally and parallel extending rails 22 so as to be movable thereon. Therefore, as the winding diameter of the rewinding rolls 12 increases during the winding operation, the hanger frame 21 can be positively or passively moved rearwardly. Thus, for example, contact rolls 41 may be adapted to bear against rolls 12 as the diameters of rolls 12 increase so that hanger frame 21 is free to move rearwardly on rollers 44 as rolls 12 bear against rolls 41 mounted by pivot arm 41*a* to abutment means 42 which is independent of frame 21. Further, they can be transferred from the winding operative position to the rewound roll removal position and also to the fresh roll core supply position. The conditions in which the the hanger frame 21 has been retracted to the roll removal position and the fresh roll core supply position are shown in alternate long and short dash lines and alternate long and two short dashes lines in FIG. 1, respectively. The reference characters A, B and C indicate, respectively, the winding operative position, the roll removal position and the fresh roll core supply position of the assembly comprising the hanger frame 21 with the holder frame 19 supporting the rewinding rolls 12. It will be understood by those skilled in the art that any convenient drive means, indicated, for example, by reference number 40 in FIG. 1, may be employed for translating carrier 21 along guide 22.

Below the roll removal position B of the assembly there is provided means, generally indicated as 23, for receiving and transferring out the slitted strip rewound rolls when the hanger frame 21 is retracted to the position B. In the embodiment illustrated in the drawings, the rewound roll receiving and transferring-out means 23 comprises a lift table 26 provided with expansible legs 25, and roll receivers 27 arranged on said lift table 26. The roll receivers 27 can be transferred out to a packaging line by arranging the entire lift table 26 to be movable transversely (i.e., in a direction at right angles to the direction of movement of the hanger frame 21) or by making the surface of the lift table 26 in the form of a roller conveyor on which said rewound roll receivers 27 are then placed.

Further, according to the invention, there is provided a fresh rewinding roll core supply means generally indicated as 28 for supplying fresh bobbins or cores to the roll support means when the hanger frame 21 arrives at the fresh roll core supply position C. The fresh bobbin or core supply means 28 comprises pairs of swing arms 30 each having a U-shaped bobbin or core receiving portion 31 formed at the free end thereof to support a bobbin or core 32 therein in spanning relation. Each of the swing arms 30 is movable from a wait position shown in solid lines in FIG. 1 to an upper supply position, at which the fresh bobbins or cores are transferred to rewinding roll support means, as described herein below.

During the winding operation, the hanger frame 21 is in the solid-line position A shown in FIG. 1 with the holder frame 19 being maintained vertically and the slitted-strip rewinding rolls 12 being arranged in two different levels. In this condition, as the winding diameter increases as a slitted strip is rewound on each roll, the holder frame 19 is retracted along with the hanger frame 21 while maintaining their conditions unchanged.

When the rewinding rolls 12 have been sufficiently increased in diameter, the winding operation is stopped and the hanger frame 21 is retracted, as by rollers 44 acting on guide 22, to the roll removal position B shown in alternate long and short lines in FIG. 1. The movement of the hanger frames 21 holding the holder frame 19 may be effected by hydraulic drive means indicated generally at 40. At this position, the holder frame 19 is turned around the pivot shafts 20 from the vertical condition to the horizontal condition. This turning movement of the holder frame 19 may also be effected either by hydraulic drive means or manually. The turning movement of the holder frame 19 may take place after the completion of or during the movement of the hanger frame 21 from the winding position A to the roll removal position B. When the holder frame 19 is brought into a horizontal condition in this manner it follows that all the rewound rolls 12 are horizontally arranged.

In this condition, the lift table 26 is lifted from the lower position to the upper position for reception until the rewound roll receivers 27 on the table 26 are brought into a position where the rewound roll receivers 27 can engage from below and carry the corresponding rewound rolls 12. The upward and downward movement of the lift table 26 may also be effected by hydraulic drive means. The support for the rewound rolls by the rewound roll support means is then released, whereby the rewound rolls are carried on the corresponding receivers 27. Thereafter, the lift table 26 is lowered and the rewound rolls 12 are transferred along with the receivers out of the system.

The holder frame 19, from which the rewound rolls have been removed, is then brought back into its vertical condition and moved along with the hanger frame 21 to the fresh bobbin or core supply position C shown in alternate long and two short dashes lines in FIG. 1. At this position, the swing arms 30 are upwardly turned until bobbins 32 supported in their receiving portions 31 at their front ends reach the levels of the respective support shafts at the front ends of the support arms 13 on the holder frame 19. The bobbins 32 are then engaged with the bobbin support axles 14 whereupon the swing arms 30 are retracted to their original positions. It will be understood that engagement of a bobbin 32 by support arms 13 may be effected in any convenient way such as, for example, by spring loaded axles 14, described above, or by adjusting the distance between adjustably mounted arms 13, also described above, to permit insertion of a bobbin 32 between a pair of axles 14. The holder frame 19 having fresh bobbins thus mounted thereon is moved along with the hanger frames 21 back to the winding operative position.

As is apparent from the foregoing description of the invention with reference to an embodiment thereof, according to the invention, the holder frame 19 in which the support means 14 for removably supporting slitted-strip rewinding rolls 12 are arranged in two different levels is capable of moving along with the hanger frames 21 from the winding operative position to the rewound roll removal position and capable of turning from a vertical condition to a horizontal condition and, on the other hand, there is provided a rewound roll receiving and transferring out means for carrying thereon the rewound rolls which have been supported on the holder frame 19 held in its horizontal condition. According to the invention the operation of removal of rewound rolls can be carried out solely mechanically and extremely efficiently. Particularly, the ability to carry out operation solely mechanically and automatically is advantageous in that it assures that there is no trouble to the handling even in the case of a heavy product. Further, it is possible to shorten the time that no winding operation is being effected, i.e., the time taken to remove the rewound rolls. Coupled with this, the provision of means for automatically supporting fresh bobbins or cores enables the entire operation for removal of rewound rolls and for mounting of fresh bobbins or cores to be carried out solely mechanically and solely automatically.

In addition, rendering the holder frame for the rewound roll support means rearwardly movable in accordance with the present invention is useful not only for the removal and exchange of rewinding rolls but also for adjustment of a slitting mechanism, insertion of paper and other preparatory operations since the rewinding roll support frame can be retracted.

What we claim is:

1. An apparatus for rewinding slitted material from a slitting machine and exchanging rewound rolls, comprising:

a frame;

a plurality of slitted rewinding roll support means mounted onto said frame and arranged in two horizontally extending rows, each of said roll support means including a rewinding core rotatably and detachably mounted to said roll support means for receiving slitted material from a slitting machine and drive means for winding said core;

a carrier rotatably supporting said frame;

pivotal support means between said carrier and said frame for pivotally supporting said frame on said carrier about a horizontal axis of said frame, said horizontal axis being intermediate of and generally parallel to said two rows of slitted strip rewinding roll supporting means;

guide means adapted to provide a track for allowing forward and retracted movement of said carrier;

roller means on said carrier for mounting said carrier on said guide means;

means for positioning said carrier along said guide means from a forward position substantially adjacent said slitting machine for a rewinding operation, to a retracted position for a roll removal operation; and means for rotating said frame approximately 90° about said horizontal axis from a first rotary position in which said two rows of said rewinding cores on said rewinding roll support means define a generally vertical plane, to a second rotary position in which said two rows of said rewinding cores define a generally horizontal plane, such that when said carrier is in said forward position, said frame is in said first rotary position to allow all of said rewinding cores to rewind slitted material simultaneously and when said carrier is in said retracted position, said frame is in said second rotary position for said roll removing operation.

2. An apparatus according to claim 1 which further comprises removal means for receiving and transferring out rewound rolls from said slitted strip rewinding roll support means.

3. An apparatus according to claim 2 wherein said removal means comprises a lift table.

4. An apparatus according to claim 2 which further comprises an extension on said guide means such that said carrier is capable of being moved to a further retracted position to allow fresh cores for rewinding to be mounted to said slitted strip rewinding roll support means.

5. An apparatus according to claim 4 which further comprises supply means for providing fresh cores for rewinding to said slitted strip rewinding roll support means.

6. An apparatus according to claim 5 wherein said supply means comprises swing arms adapted to position fresh cores for engagement by said slitted strip rewinding roll support means.

7. An apparatus according to claim 6 wherein said roll support means further includes two arm structures for supporting said core and said frame includes means for adjustably mounting said slitted rewinding roll support means thereto such that said arm structures are laterally adjustable in a direction substantially parallel to said horizontal axis of said frame to accommodate slitted material of various widths.

8. An apparatus according to claim 1 wherein said roll support means are mounted to said frame such that adjacent strips of slitted material are rewound on alternating vertically arranged rewinding cores.

9. A method for rewinding slitted strips and exchanging rewound rolls, comprising the steps of:

positioning a plurality of rewinding cores in generally horizontally extending rows at a forward first operative rotary position to define a generally vertical plane;

rewinding slitted strips essentially simultaneously onto all of said plurality of rewinding cores;

stopping said rewinding operation after a predetermined length of slitted material has been wound on the rewinding cores;

retracting said plurality of rewinding cores to a second position for roll removal;

orienting said plurality of rewinding cores to define a generally horizontal plane;

removing, at said second position, all of said rewound cores from their rewinding means, after said orienting step;

positioning said rewinding means in an essentially vertical plane for supplying fresh rewinding cores;

supplying a plurality of fresh rewinding cores to said rewinding means; and returning said rewinding means with said fresh rewinding cores to said first rotary operative position.

10. A method according to claim 9 wherein said fresh core supplying step includes the step of further retracting said rewinding means to a roll supply position before supplying said fresh cores to said rewinding means.

11. A method according to claim 10 further including the step of retracting said rewinding cores during said rewinding operation a distance equal to about the increase in the diameters of said rewinding cores.

12. A method according to claim 11 wherein the steps of retracting said rewinding cores to said second position and orienting said rewinding cores to define said horizontal plane are carried out essentially simultaneously.

* * * * *